United States Patent [19]

Hokama

[11] 4,346,720

[45] * Aug. 31, 1982

[54] CLAMP-ON ARTIFICIAL FINGERNAIL

[75] Inventor: Yosh Hokama, Torrance, Calif.

[73] Assignee: International Beauty Distributors, Inc., Gardena, Calif.

[ * ] Notice: The portion of the term of this patent subsequent to Jan. 23, 1996, has been disclaimed.

[21] Appl. No.: 43,021

[22] Filed: May 29, 1979

[51] Int. Cl.[3] ..... A45D 29/00

[52] U.S. Cl. ..... 132/73

[58] Field of Search ..... 132/73, 88.5, 88.7, 132/1

[56] References Cited

U.S. PATENT DOCUMENTS

| | | | |
|---|---|---|---|
| 3,037,514 | 6/1962 | Lappe | 132/88.7 X |
| 3,277,900 | 10/1966 | Lappe | 132/73 |
| 3,487,831 | 1/1970 | Jaume et al. | 132/73 |
| 3,552,401 | 1/1971 | Michaelson | 132/73 |
| 4,135,526 | 1/1979 | Matranga et al. | 132/73 |

*Primary Examiner*—David R. Sadowski

*Attorney, Agent, or Firm*—William W. Haefliger

[57] ABSTRACT

An artificial fingernail is formed to have thickness variations, and curvature, that aid in securely bonding the artificial fingernail to the natural nail, and also strengthen the artificial nail.

12 Claims, 9 Drawing Figures

CLAMP-ON ARTIFICIAL FINGERNAIL

BACKGROUND OF THE INVENTION

This invention relates generally to the application and retention of artificial fingernails to natural fingernails; more specifically, it concerns a simple and rapid method of attaching artificial nails characterized by the elimination of prior problems and disadvantages.

It has been conventional practice to adhesively attach artificial fingernails directly onto the major extents of upper exposed surfaces of natural fingernails. This method not only risks damage to the natural nails as through promotion of fungus growth at the interface between the nails, but it also requires considerable time and effort and often results in an unsightly cumbersome and/or fake appearance.

If the artificial nail is attached to only the forwardmost extent of the vertical nail, as for example as described in U.S. Pat. No. 4,007,748, the desirably thin artificial nail tends to become too flexible, especially if it projects forwardly a considerable distance from the natural nail; also the undersides of the lateral edge portions of the artificial nail intended to bond to the natural nail tend to raise from the natural nail, undesirably reducing the strength of the bond.

SUMMARY OF THE INVENTION

It is a major object of the invention to provide an improved artificial fingernail characterized as overcoming the problems and difficulties referred to bove. Basically, the artificial nail comprises:

(a) a thin plastic sheet element sized to provide, when attached to the natural fingernail, a forward extension of the natural fingernail, (b) said element having a generally U-shaped boundary region extending forwardly of the rearwardmost extent of the element, (c) said element having an upper arch region with curvature such that the lateral sides of the element extend generally downwardly from the arch to be spread apart when said sides are pressed down on a natural nail, (d) said lateral sides having thickness at said boundary region in excess of the thickness of the element at said arch region.

As will appear, substantially all of the boundary region, i.e. at least both lateral side portions of the nail, have thickness substantially in excess of the thickness of the element at the upper arch portion (which continues throughout the nail length), that differential thickness characterized as increasing the strength of the nail and also accommodating its flexure upon application to a natural nail, such flexure resulting in enhanced gripping of the natural nail by the thickened side portions of the nail. The result is a more stable, stronger, and more adherent artificial nail.

Further, the artificial nail may have a crescent shaped stop at its underside, to engage the forward edge of the natural nail and position the latter, upon application.

These and other objects and advantages of the invention, as well as the details of an illustrative embodiment, will be more fully understood from the following description and drawings, in which:

DRAWING DESCRIPTION

DETAILED DESCRIPTION

Figure 5:
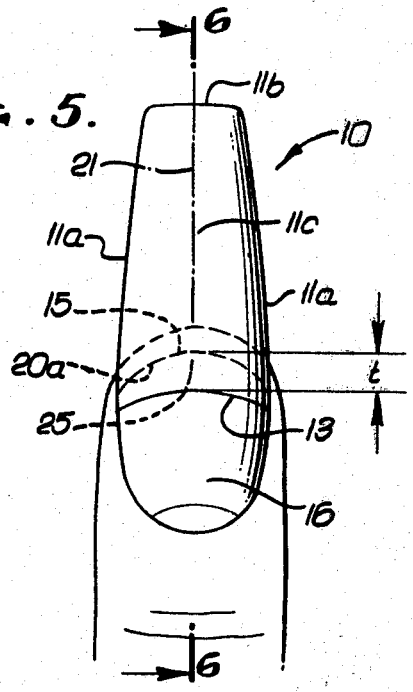
FIG. 5 is a top plan view showing application of the artificial nail to a natural fingernail.
Figure 6:
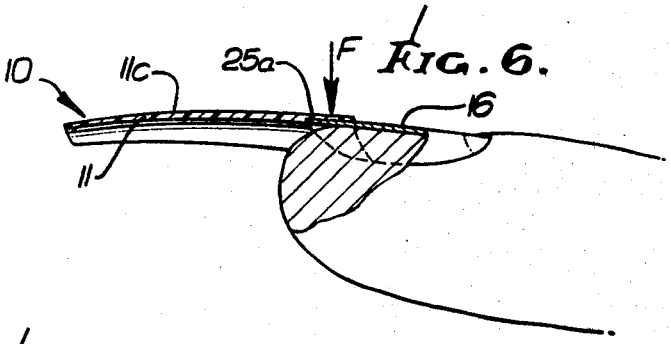
FIG. 6 is a section on lines 6—6 of FIG. 5.

In the drawings, a solid artificial fingernail 10 is attachable to natural human fingernail 16 seen in FIGS. 5 and 6, for example. The artificial, plastic nail body 11 is longitudinally elongated; for example it may have a length greater than twice its width; however, less lengths are also contemplated.

Figure 2:
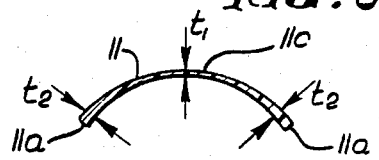
FIG. 2 is an enlarged section on lines 2—2 of FIG. 1.
Figure 3:
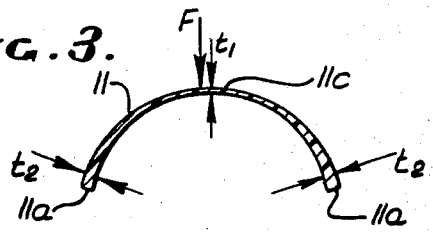
FIG. 3 is an enlarged section on lines 3—3 of FIG. 1.
Figure 4:
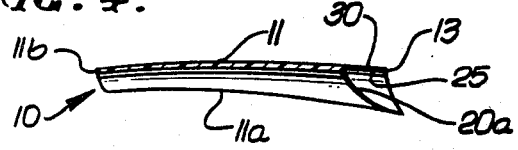
FIG. 4 is a section on lines 4—4 of FIG. 1.

The FIGS. 2 and 3 cross sections of nail body 11 show it to have in unflexed condition a generally semicircular, or circular section conformation, i.e. to have widthwise curvature substantially greater than that of a typical natural nail to which it is to be applied. Note in FIG. 7 that the unflexed width $\omega_1$ of the artificial nail body is substantially less than the width $\omega_2$ of the natural nail to which the artificial nail is to be applied.

Figure 1:
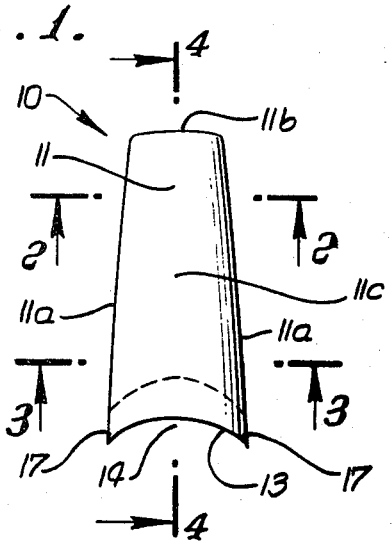
FIG. 1 is a top plan view of an artificial nail incorporating the invention.
Figure 7:
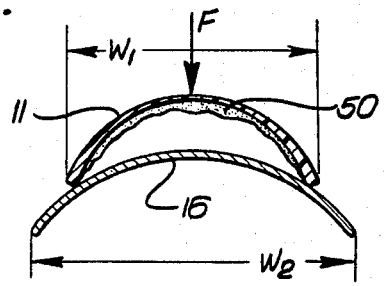
FIGS. 7 and 8 show the method of flexing the artificial nail to cause it to grip a natural nail.
Figure 8:
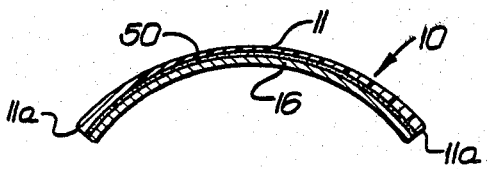

FIGS. 1 and 5 show also that the artificial nail boundary along sides 11*a* and front 11*b* is generally U-shaped forwardly of the rearwardmost extent of the nail element, the two sides tapering in the direction toward front 11*b*. Further, the element has an upper arch region 11*c* with curvature such that the lateral sides 11*a* extend generally downwardly from the arch to be spread apart when the sides 11*a* are pressed down on the natural nail. Further, the arch region along the nail length is more flexible than the nail region at and adjacent the sides 11*a* by virtue of its reduced thickness $t_1$ as related to relatively greater thicknesses $t_2$ at and along the sides, whereby the center of the nail body may be flexed downwardly as in FIG. 8, while the sides being relatively less flexible tend to remain clamped down, or "grip" against the natural nail as they are spread apart laterally. This in turn facilitates a closely conforming gripping of the undersides of rear portions of the nail body to the natural nail, whereby a drop or two of glue initially applied at 50 to the nail underside as seen in FIG. 7 is spread apart during nail down-flexing, to impart a very good bond between the artificial and natural nails.

The thickness of the nail body, along its length, decreases from a maximum proximate each side 11*a* to a minimum near or at the top of the arch region 11*c*, medially of the nail (i.e along the intersection of the nail with a plane bisecting the nail, lengthwise thereof). Accordingly, substantially the entire boundary region of the nail (i.e. along and proximate edge portions 11*a*) exceeds substantially the thickness of the nail at the arch, these conditions prevailing substantially throughout the length of the nail and particularly at the nail region to be bonded to the natural nail, and contributing to the flexing and gripping characteristics referred to above.

The body 11 desirably has a generally concave rearward peripheral distal edge 13 forming a recess 14 to expose the main body of the natural (as for example human) fingernail 16, as better seen in FIG. 5. Accordingly, the illustrated body 11 forms two laterally spaced, rearwardly projecting cusps 17 at the points of locations where the lateral sides 11*a* meet the lateral extremities of the concave edge 13. The body 11 may consist of an acetate type, or other, flexible plastic material.

It will be noted that the molded plastic body has a stop shoulder or step 20*a* at the proximal underside juncture of the main extent of the nail with a reduced thickness top strip portion 30 of the nail. The stop or step is preferably located forwardly of edge 13 and has crescent shape, with lateral extremities which approach and terminate at the cusps 13. The shoulder 20*a* is forwardly spaced from rearward edge 13 at a maximum distance indicated at "t", proximate the medial longitudinal axis 21 of the body.

Referring now to the method of attaching the thus provided artificial fingernail 10 to the natural nail 16, an abutting contact is effected between the stop shoulder 20*a* with the forward edge 15 of the natural nail, as seen in FIGS. 5 and 6 with force F applied (as in FIGS. 6 and 7) to flex the nail body 11 downwardly so as to "grip" the artificial nail as explained above. Preliminarily, the natural fingernail 16 may be trimmed as by scissors to provide and conform the blunt edge 15 thereof to the natural shape of edge 13; however, an exact match is not required. Also, a quick drying liquid adhesive is applied to an underside crescent shaped arc portion (designated at 25) of the artificial nail, near stop 20*a* and edge 13, as seen in FIG. 5, the glue or adhesive also indicated at 50 in FIG. 7. Portion 25 is translucent.

When the abutting contact is made as described, the liquid adhesive on crescent 25 is underlapped by a corresponding crescent shaped upper surface edge portion 25*a* of the natural fingernail, as seen in FIG. 5. Upon quick drying of the adhesive, the two narrow crescent shaped portions are firmly bonded together, and the main surface extent of the natural nail is not contacted by the liquid adhesive, or covered by the plastic nail, preserving the health of said main surface of the natural nail.

The crescent shaped portions of the two nails are retained together for the short period of time required for spreading and quick drying of the adhesive. After a few seconds, the artificial fingernail is completely and durably secured to the natural fingernail forward of blunt edge 15. One unusually advantageous adhesive is that sold under the trademark "5-Second" nail glue, a product of Toagosei Chemical Company, Tokyo, Japan. It is otherwise known as an alpha cyanoacrylate, and is capable of curing or drying in air in about 4–6 seconds.

Additional adhesive may be applied to the rearward edge 13 and to edge 15 (see FIG. 7) to strengthen the bonded attachment. Finally, the upper surface of the artificial nail adjacent edge 13 may be filed or buffed, and nail polish applied.

Figure 9:
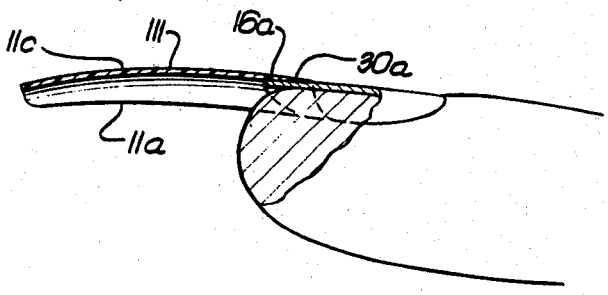
FIG. 9 is a view like FIG. 6, but showing a modification.

FIG. 9 shows a modification wherein the step shoulder 20*a* has been removed, and the rearward extent 30*a* of the artificial nail overlaps and is bonded to the top and forward surface 16*a* of the natural nail. Otherwise, the artificial nail body 111 is the same as body 11 described above, with thickness variations between regions 11*a* and 11*c* as referred to.

Elongated artificial nails, as shown, are strengthened by means of the present invention, so as to prevent unwanted flexing thereof, forwardly of the natural nails to which they are attached.

I claim:

1. A solid artificial fingernail attachable to a natural fingernail, comprising (a) a thin plastic sheet element sized to provide, when attached to the natural fingernail, a forward and longitudinal extension of the natural fingernail, (b) said element having a generally U-shaped boundary region extending forwardly of the rearwardmost extent of the element, (c) said element having a longitudinally elongated upper arch region with curvature such that the lateral sides of the element extend generally downwardly from the arch to be spread apart when said sides are pressed down on a natural nail, (d) said lateral sides having thickness at said boundary region, substantially in excess of the thickness of the element at said elongated arch region, (e) said element gradually increasing in thickness from said upper arch region laterally toward said lateral boundary region along each of said lateral sides to facilitate relative and flexible spreading of said lateral sides together with flexible bending of said arch region, for downwardly gripping the natural fingernail.

2. The artificial fingernail of claim 1 wherein substantially the entire boundary region has thickness substantially in excess of the thickness of the element at said arch region.

3. The artificial nail of claim 1 including said natural fingernail onto a forward portion of which said artificial nail is bonded, with portions of said thickened boundary gripping the natural nail and said arch being in flexed condition.

4. The artificial nail of claim 1 wherein the artificial nail has a semi-circular, C-shaped, un-flexed cross section in planes normal to the lengthwise dimension of the nail.

5. The artificial nail of claim 4 wherein the length of said artificial nail exceeds twice the width thereof between said lateral sides.

6. The artificial fingernail of claim 1 wherein:

(a) said element has a rearward edge and forms a recess to receive and conform generally to the shape of the convex forward edge of the artificial fingernail, (b) there being a stop at the underside of the artificial fingernail in spaced relation to said rearward edge, the stop located to abut the natural fingernail forward edge to position the artificial fingernail so that an underside portion of the artificial fingernail may overlap and be bonded to an upper surface portion of the natural nail.

7. The artificial fingernail of claim 6 which consists of molded acetate resin.

8. The artificial fingernail of claim 6 wherein said stop is generally crescent shaped.

9. The artificial fingernail of claim 8 wherein the artificial fingernail includes two rearwardly projecting cusps toward which extremities of said crescent shaped stop extend.

10. The artificial fingernail of claim 9 wherein the element includes a reduced thickness strip between said stop and said rearward edge, said strip defining said underside portion.

11. The artificial fingernail of claim 9 wherein said strip is translucent.

12. The artificial fingernail of claim 9 and including the natural fingernail in combination therewith, with the forward edge of the natural fingernail abutting the stop, the strip adherent to the top surface of the natural fingernail, and including quick drying liquid adhesive between said strip and the natural fingernail for effecting a bond therebetween.

* * * * *